US005867103A

United States Patent [19]

Taylor, Jr.

[11] Patent Number: 5,867,103

[45] Date of Patent: Feb. 2, 1999

[54] MONITORED PERSON TRACKING SYSTEM

[76] Inventor: John E. Taylor, Jr., 3305 Sandpiper Dr., Punta Gorda, Fla. 33950

[21] Appl. No.: 926,746

[22] Filed: Sep. 10, 1997

[51] Int. Cl.[6] ..... G08B 21/00; G08B 25/00

[52] U.S. Cl. ..... 340/573; 340/539; 340/572; 379/38

[58] Field of Search ..... 340/573, 572, 340/539; 379/38

[56] References Cited

U.S. PATENT DOCUMENTS 5,461,390 10/1995 Hoshen ..... 340/573
5,731,757 3/1998 Layson Jr. .

*Primary Examiner*—Glen Swann

[57] ABSTRACT

A portable monitoring device is provided for each monitored person which secures to a respective monitored person and which has tamper detection means contained therein. The portable monitoring device receives a signal from a detached sending unit and transmits a signal for transfer to a central location. A position reference is arrived at following a mathematical computation. Storage of the position reference may occur within a locational tracking database along with associated occurrence references which identify when the portable monitoring device was at a specific positional location. The locational tracking database will be used as a law enforcement tool. Excluded sites may be designated within the system, which the monitored person may not enter. A dual tracking monitoring enables a restrictor person to be protected from a restrictee person by determining when the restrictee person comes within a predetermined distance measurement from the restrictor person and generating a notification.

10 Claims, 5 Drawing Sheets

MONITORED PERSON TRACKING SYSTEM

BACKGROUND

1. Field of the Invention

Generally, the invention relates to locational tracking of monitored persons. More specifically, the invention relates to such tracking wherein at least one monitored person has a portable monitoring device securely attached thereto including means to detect tampering with the portable monitoring device.

2. Description of the Prior Art

Our society has been compelled to confine individuals as a result of their behavior which has been deem unacceptable to the best interest of society. Historically, such confinement has occurred at centralized locations where numerous confinements occur simultaneously. It is expensive for society to maintain such centralized locations due primarily to construction cost, upkeep cost, supervisory personnel expense and medical care for the persons being confined. These persons being confined represent both those convicted of committing a crime as well as those accused of committing a crime, but awaiting trial.

Our society has begun to seek alternative means of confining those convicted of crimes which are deemed to be non-violent as well as those accused of committing a crime and awaiting trial. Parole, probation and house arrest programs have existed for some time and are being extensively utilized by the courts for certain type of crimes.

Additionally, our society has recently made progress toward restricting certain habitual offenders of certain type of crimes even following completion of court appointed sentences. These restrictions are coming in the form of civil actions as compared to criminal actions. Some circumstances require continued conventional confinement while others require site confinement or other monitoring of activities. Examples of such crimes include child molestation and other sex crimes.

In certain situations it is desired to restrict the activities of an individual without requiring constant presence in a certain designated confinement area, as exampled by a select residential premises. In these cases, monitoring of daily activities may be desired. In these cases, a record of the monitored persons movements, the where and the when, may be sufficient.

When an individual possesses the knowledge that a record is being made of his or her travels, that individual is more likely to exercise self restraint and abstain from criminal activities or association with unseemly persons or places. Beyond the deterrent factor of such monitoring, a record of activities of persons who have previously demonstrated a propensity toward criminal conduct would be an invaluable aid to law enforcement officials in solving crimes.

One example of such a restriction of activities placed on an individual would involve those individuals who are under court order to not have contact with a certain individual, or individuals, or under court order to remain away from a certain physical location, or locations. One example of such a court order is a restraining order which will detail certain actions which the person under order must restrain from exercising. Failure to comply with the terms of the order generally will bring further involvement of the court. It is noted that individuals under such a court order may not have been previously convicted of a crime by a court of law.

Monitoring of activities, with a record of where and when the monitored person was in a certain location, may benefit the monitored person. When a crime is committed it is routine for the police to consider those persons which have previously been associated with similar crimes. Therefore, a record of the movements of the monitored person may lead to quickly exonerate individuals which might otherwise be deem to be suspects for a respective crime. This benefits the individual as well as prevents the police from devoting resources which would be better spent pursuing other leads. Similarly, when a person is accused of violating a restraining order issued by a court such a record might prevent further legal action being taken against the person.

Referring now specifically to site confinement, it is conventionally known to utilize various monitoring systems to provide for such site confinement of individuals wherein means are provided within the respective system to indicate that a respective individual has violated boundaries of their respective site. Several of these systems include means to detect tampering with various elements of the system.

The most common type of such a site confinement system comprises three devices being a central processing unit, at least one transportable device and at least one base unit. The transportable device, which securely attaches to the individual being confined, comprises communication means to communicate with the base unit. The base unit, which is positioned within the boundaries of the confinement site, comprises two types of communication means. The first of the communication means allows the base unit to communicate with the transportable device. The second of the communication means allows the base unit to communicate with the central processing unit. Generally, this communication is over a ground based telephone system. When communication is not present between the transportable device and the base unit, the base unit, utilizing the second communication means, communicates with the central processing unit to notify an oversight authority of a possible violation of the confinement by the individual. As can readily be seen such systems have a general deficiency in that they are bound to a single designated site location. Several systems have been proposed which allow for a wider tracking of individuals.

As can be seen various attempts have been made to provide for a method of restricting the activities of certain individuals. These attempts have been less efficient than desired. As such, it may be appreciated that there continues to be a need for a system which may monitor at least one individual without relying upon limitations associated with site boundaries. The present invention substantially fulfills these needs.

SUMMARY

In view of the foregoing disadvantages inherent in the known types of monitoring systems, your applicant has devised a system which provides for a locational tracking of a plurality of monitored persons. The system has a portable monitoring device for each of the monitored persons. Each portable monitoring device has means to secure the device to a respective monitored person and means to detect tampering with the secured device. Additionally, each portable monitoring device has means to receive a distinct signal generated by a detached sending unit. Each portable monitoring device also has means to transmit a signal containing data. The system further has means to acquire the signal containing data transmitted by each respective portable monitoring device. The system has means to determine a positional location of the portable monitoring device based, at least in part, upon the distinct signal received by the portable monitoring device. The system has means to mark, at least within a range of time references, when the positional location reference was determined in the form of an occurrence reference. The system has means to store, for archival retention within a locational tracking database, at least a series of the position references and associative occurrence references of each portable monitoring devices of the tracking system.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

It is therefore a primary object of the present invention to provide for a locational tracking of monitored individuals.

Other object include;

a) to provide for a portable monitoring device which may be secured to a monitored person.

b) to provide for detecting tampering with the portable monitoring device.

c) to provide for a transfer of a signal from the portable monitoring device.

d) to provide for a receipt of the signal transferred by the portable monitoring device.

e) to provide for determining a position reference of a positional location of the portable monitoring device based upon at least one signal received by the portable monitoring device wherein the signal is generated by at least one detached sending unit.

f) to provide for generating an associated occurrence reference indicative of a time span related to the positional reference.

g) to provide for a storage of at least a series of positional references and associated occurrence references within a locational tracking database.

h) to provide for crime solving by providing law enforcement with a locational tracking database.

i) to provide for deterring crime by providing the monitored person with a knowledge of the creation of the locational tracking database.

j) to provide for an entering of a known location reference and a known range of time references and for a subsequent comparison of the entered references with the references contained within the locational tracking database.

k) to provide for an entering of an excluded location reference related to an excluded location and comparison of the position reference of the portable monitoring device with the excluded location reference.

l) to provide for at least a pair of portable monitoring devices which each transfer position references for comparison to determine if any select pair of the portable monitoring devices are within a predetermined distance measurement of each other.

m) to provide for a notification if any select pair of portable monitoring devices are within the predetermined distance measurement of each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
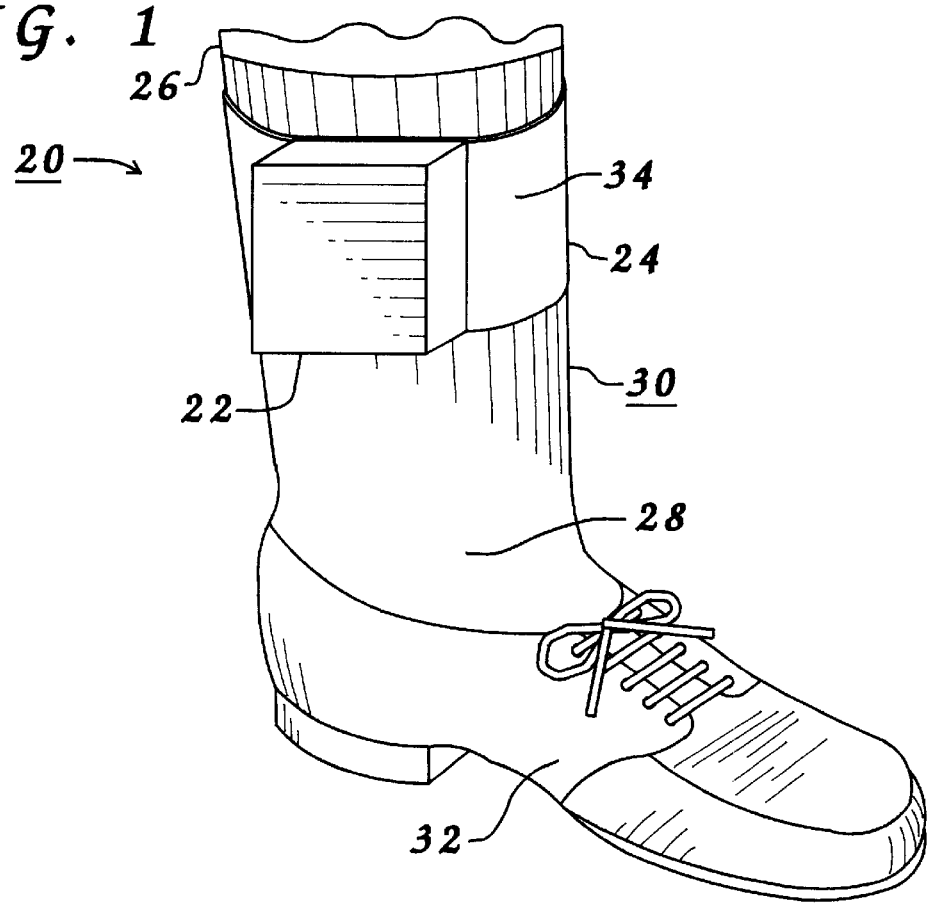
FIG. 1 is a perspective view of a portable monitoring device attached to a monitored person.

Referring now to the drawings where like reference numerals refer to like parts throughout the various views.

Portable Monitoring Device

It is a requirement of the instant invention that a portable monitoring device, (PMD), be provided for each monitored, or restrictee, person. It is a further requirement that the PMD comprise; means to attach the PMD to the monitored person, means to detect tampering with the PMD, means to receive a signal from a detached sending unit, and means to transmit a signal.

The art is rich with such devices for usage within various systems, as exampled by those systems designed to provide for site confinement of individuals. Any of these devices conventionally known in the art may be employed for the instant invention.

The means to secure may involve surrounding engagement of a portion of the body of the monitored person or may involve implantation. The preferred method of securement is the surrounding engagement method. The most obvious attachment locations for such attachment being around a wrist, around an ankle or around the neck. Implantation is possible, though less desirable due to power supply requirements.

FIG. 1 depicts a portable monitoring device 20 which comprises a housing 22 and a band 24. Band 24 surrounds a leg 26, at an ankle 28, and locks to housing 22 to secure portable monitoring device 20 to a monitored person 30. Band 24 is adjusted to be of a sufficient length that portable monitoring device 20 will not move past a foot 32.

The means to detect tampering, wherein the securing means involve surrounding engagement of a portion of the body of the monitored person, will require that the surrounding band retain its prior integrity. This will involve means to ensure that the surrounding band is intact and, if connected to a housing, that such connections are intact. Without regard for the specific securing means employed, it is a requirement that means be provided to detect any tampering with the housing containing the equipment.

FIG. 1 depicts band 24 having a severing detection device 34 contained therein. Severing detection device 34, contained within band 24, connects, at opposing ends thereof, to housing 22. As conventionally known in the art, equipment, not shown, contained in portable monitoring device 20 is capable of determining and reporting if any deviation in power through severing detection device 34 is detected. This prevents bypassing power transfer along severing detection device 34 while allowing for the severing of severing detection device 34. Similar equipment, not shown, allows for a detection of tampering with housing 22 or any other component of portable monitoring device 20.

The means to receive a signal may be performed by various types of equipment conventionally known in the art depending upon the type of signal being received. Any of these methods may be employed with the instant invention.

Figure 2:
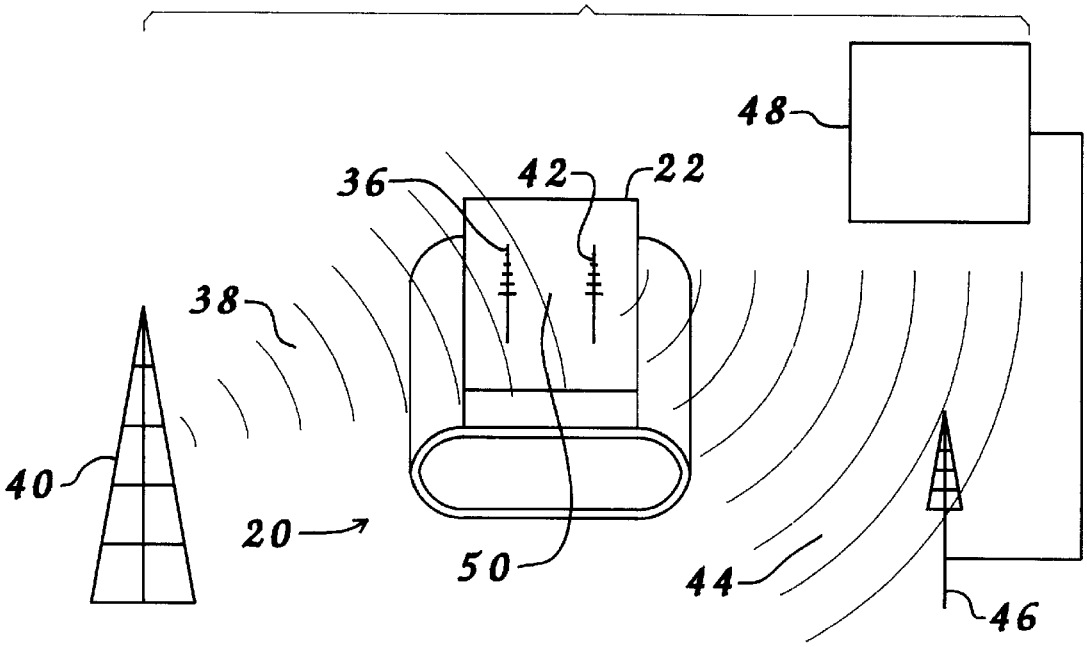
FIG. 2 is an illustration of an embodiment of a tracking system.

FIG. 2 depicts a receive antenna 36 contained within housing 22 of portable monitoring device 20. Receive antenna 36 is capable of receiving a signal 38, or signals, as sent by a detached sending unit 40, in this example a ground based unit.

The means to transmit a signal may involve sending the signal following a direct contact with a base unit, utilizing an indirect wireless contact with a base unit or may utilize a wireless broadcast. The direct contact with a base unit is exampled by having a lead from the base unit which periodically is plugged into the PMD or having the PMD periodically placed in physical contact with the base unit wherein matching contacts make contact. The indirect wireless contact with a base unit is exampled by an inferred link as conventionally known for communication between detached electronic equipment, as exampled by such communication between a desktop computer and a laptop computer. The wireless broadcast is exampled by cellular or radio broadcast.

The portable monitoring device may immediately transfer a signal containing data following receipt of the data or immediately following creation of the data. Alternatively, the portable monitoring device may have means to allow for onboard storage of data for batch transfer at a later time. When batch transfer is employed, such transfer may be on a routine schedule via wireless transmission, or may be established on a less rigid schedule over ground based system, as exampled by phone lines.

FIG. 2 depicts a transmit antenna 42 contained within housing 22 of portable monitoring device 20. Transmit antenna 42 is capable of broadcasting a signal 44.

Transmission Acquisition Means

Numerous methods are conventionally known in the art to acquire signals transmitted by other electronic equipment via ground based communication, via wireless communication or via a combination of ground based and wireless communications. Any of these methods may be employed with the instant invention. The signal transmitted by the PMD may be sent via direct contact with a base unit, indirect contact with a base unit or general wireless broadcast, as more fully described elsewhere herein. Following transmission of the signal by the portable monitoring device it is a desire to acquire that signal at a central location. This acquisition may be directly by the central location or, more likely, will involve intermediate reception by other equipment which then transfers the signal on to the central location. (The term central location is not intended to be limited to one physical location for the tracking system, but rather a location where data is gathered from distinct portable monitoring devices.)

FIG. 2 depicts portable monitoring device 20 broadcasting, using transmit antenna 42, signal 44 which is received by a cellular tower 46 which, in turn, transfers such signal to a central location 48. Signal 44 may contain information which enables a position reference 50, being where portable monitoring device 20 is located, to be computed, may contain the actual position reference 50, or may contain a series of either.

Positional Determining Means

Various systems, and devices based upon those systems, exist to provide for a determination of a positional location. Several of these systems are capable of making such a determination within a fairly narrow range of measurement. One group of such systems rely upon transmissions from satellites in orbit around our planet. Another group relies upon transmissions from ground based transmitters.

Without regard for the transmission system employed to generate a signal, or signals, each portable monitoring device will routinely receive at least one signal. This signal, or signals, is then capable of, through a mathematical computation, being reduced to a position reference indicative of a specific location, within a predetermined range of measurement. It is possible that the mathematical computation will be performed by a device located within the portable monitoring device with the actual position reference being sent within the signal of the transmitting means of the portable monitoring device. Alternatively, raw data may be sent within the signal of the transmitting means of the portable monitoring device with the mathematical computation occurring subsequent to receipt of the signal by the transmission acquisition means, as exampled by at the central location.

It is possible, and preferred in certain deployments, to have a reliance upon a primary transmission system and at least one backup transmission system. The signal(s) from the primary transmission system may be indefinite or totally absent, in which case the mathematical computation based on the signal(s) received by the portable monitoring device from the primary transmission system would be incapable of determining a position reference. In that case the portable monitoring device would switch through any backup transmission systems until the received signal(s) was present and of a quality from which a position reference might be computated.

The example which follows makes use of Global Positioning Satellites (G.P.S.), as conventionally known in the art, for determining a locational position of the respective portable monitoring device. Selection of this method of determining locational position is due to the wide coverage area and the accuracy afford by such usage. Numerous other methods, all conventionally known in the art, are adaptable for usage with the instant invention.

Numerous reference methods, all conventionally known in the art, may be employed to define each position reference, as exampled by a set of coordinates.

Figure 3:
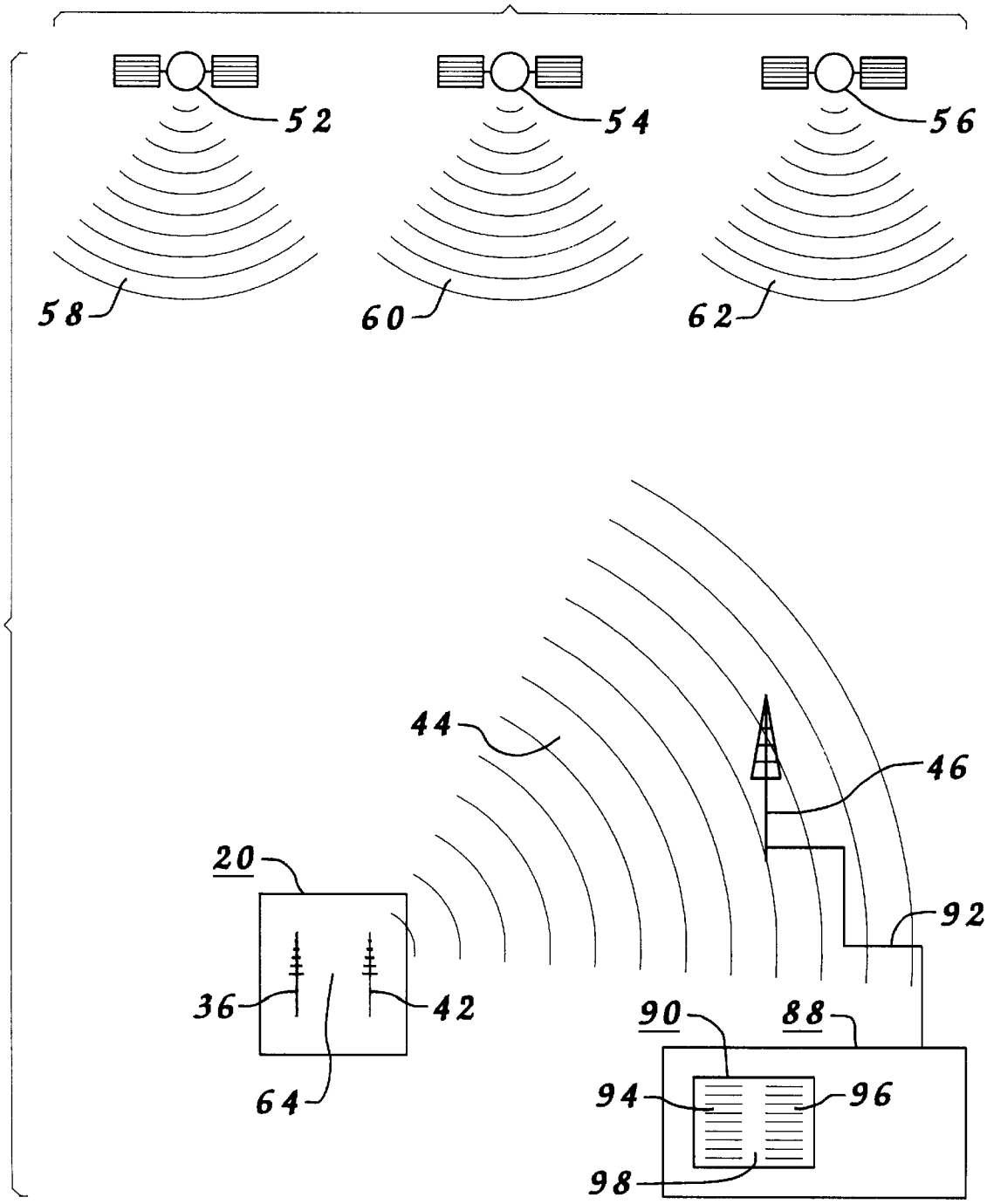
FIG. 3 is an illustration of another embodiment of the tracking system.

FIG. 3 depicts a satellite 52, a satellite 54 and a satellite 56 which each routinely generate signals 58, 60 and 62 respectively. Receive antenna 36 of portable monitoring device 20 receives such signals 58, 60 and 62. Portable monitoring device 20 may then transfer such signals, using transmit antenna 42, within signal 44, along with any distinct signal(s) created within portable monitoring device 20 which may be required to computate a position reference 64, to cellular tower 46. Alternatively, portable monitoring device 20 may perform the required mathematical computations and transfer signal 44 containing position reference 64.

Temporal Marking Means

In certain situations it is desired to provide for an indication of when each position reference was generated. This desire is a requirement when the position reference is going to be stored for historic reference, more fully described below. It is possible to provide for a temporal marking of each position reference utilizing equipment on the portable monitoring device contemporaneously with receipt of the signal(s) upon which the position reference is based. Alternatively, it is possible to provide for creation of the temporal marking at the time of receipt at the central location. Generally, it is preferred to have such temporal marking contemporaneously created with each position reference. It is possible, and in certain situations preferred, to assign a range to each position reference. This method is particularly expedient when performing batch transfers from the portable monitoring device. In certain uses a single time range will have several position references associated therewith.

Figure 4:
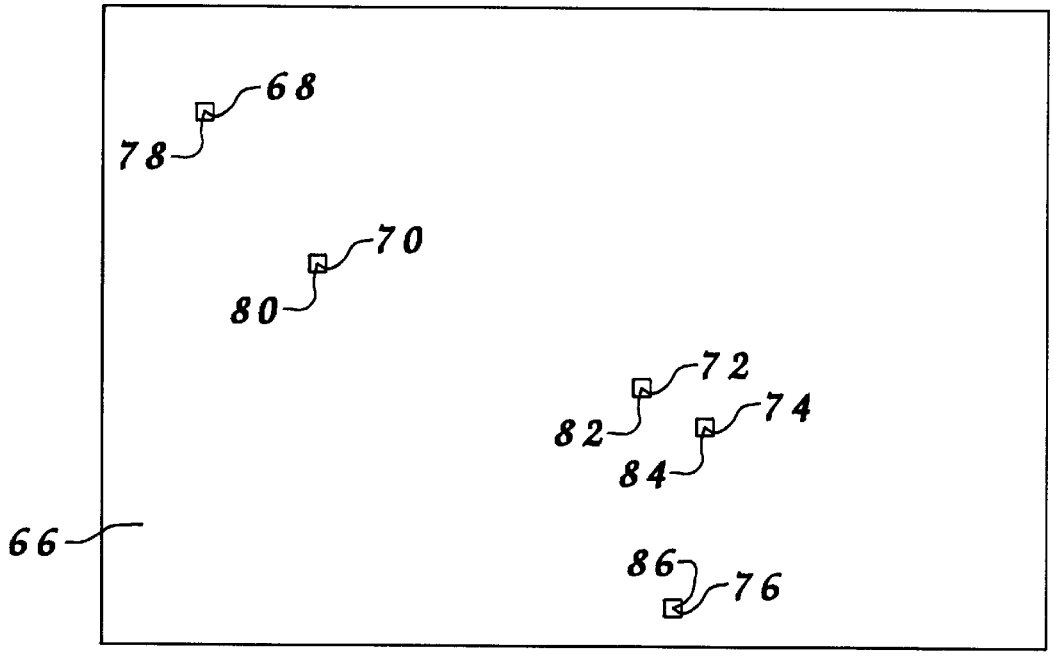
FIG. 4 is a plan view of a block with various position references and associated occurrence references distributed therein.

FIG. 4 depicts, within a block 66, a series of five position references 68, 70, 72, 74 and 76 each having an associated occurrence reference 78, 80, 82, 84 and 86 respectively. Each position reference 68, 70, 72, 74 and 76 would have a set of coordinates, or other acceptable identifying reference, associated therewith. Each associated occurrence reference 78, 80, 82, 84 and 86 would have a set of identifying information which are, or may be converted to, date and time references. In this example each adjacent sequential associated occurrence reference 78, 80, 82, 84 and 86 are a uniform measurement of time apart.

Storage Means

Numerous methods are known in the art for electronic storage of data which permit subsequent retrieval based upon select models. Any of these methods may be employed with the instant invention. It being understood that such storage of position references and associated occurrence references are not required for all embodiments of the invention.

When required, each position reference will be stored along with the associated occurrence reference. As mentioned, it is possible to assign a single range to a series of associated occurrence references. Alternatively, it is possible to provide for storage of select position references taken from the totality of position references available. One example has a computer program which examines the series of position references and identifies sequential strings of references within the series which do not vary beyond a predetermined distance measurement from all other references within the string. The computer program would then purge from the system all data between the first and the last reference within the string. This is particularly expedient where the monitored person is stationary for a long period of time, as example by sleeping for a number of hours in a generally stationary location.

FIG. 3 depicts a computer 88 having a storage device 90. Computer 88 is linked via a cable 92 to cellular tower 46 which receives signal 44 which contains data transmitted by transmit antenna 42 of portable monitoring device 20. The information contained in signal 44, following any conversion, if required, is stored within storage device 90 as a sequence of position references 94 and a sequence of associated occurrence references 96. A locational tracking database 98 is therefore formed by computer 88.

Comparison Means

There exist two modes of operation for comparison of position references of each monitored person. The first mode is real time comparison with either excluded site boundaries or proximity to other variable position references. (The term real time comparison is not meant to convey simultaneous comparison, but rather may have the actual comparison occurring at a slightly later time.) The second mode is comparison of a later defined site boundary, or site boundary and associated occurrence reference, with the data contained within the locational tracking database. It is possible that such comparison of data within the locational tracking database may be employed as evidence during a legal proceeding, either a criminal proceeding or a civil proceeding.

a. Immediate Comparison

Comparison may be made with position references from each portable monitoring device immediately subsequent to receipt thereof by the central location. In this case it is necessary to have defined either excluded locations, by similar definitions used for the position references, or by comparing the received position references with position references received from a second portable monitoring device. (In certain situations it is not a requirement that all deployed portable monitoring device have securing means or tamper detection means, as more fully described herein.)

Figure 5:
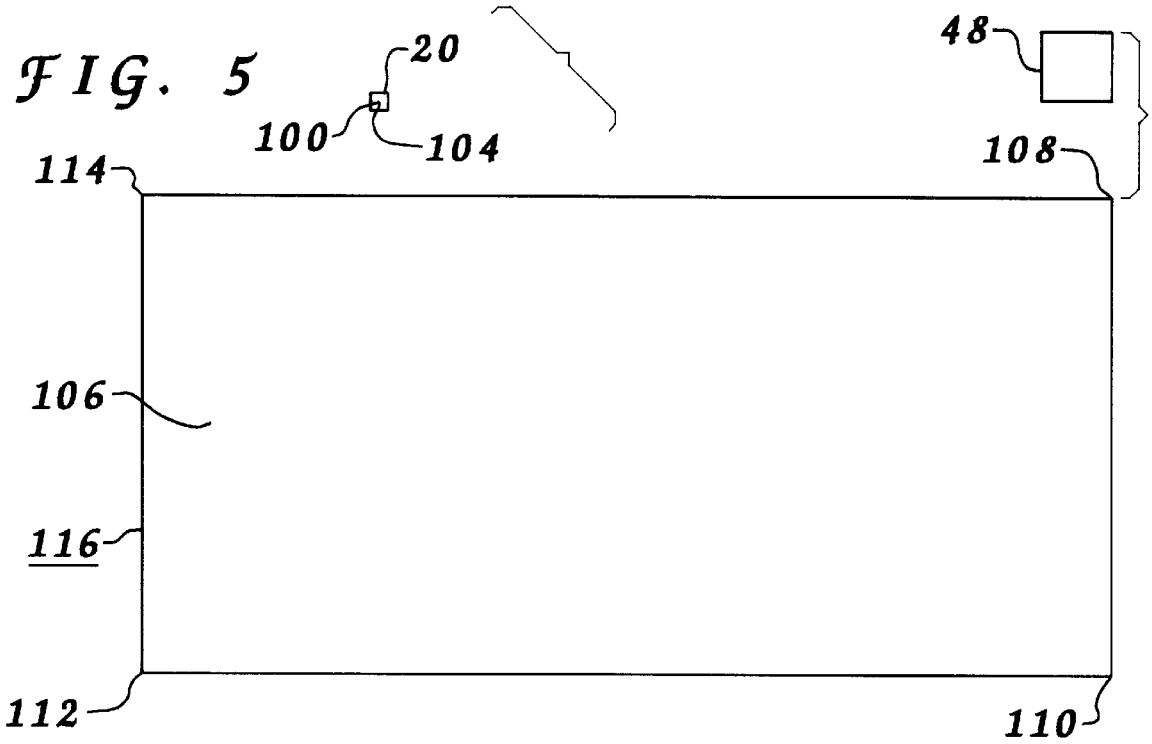
FIG. 5 is a plan view of an excluded site.
Figure 6:
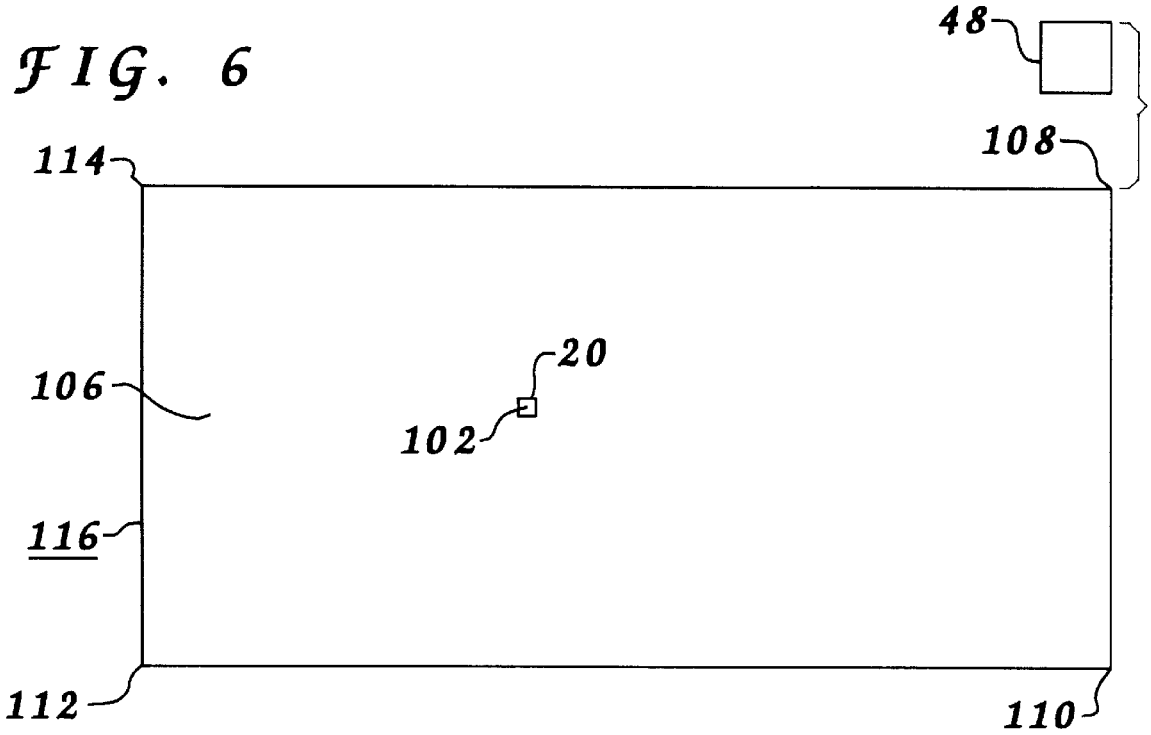
FIG. 6 is an alternative view of the view depicted in FIG. 5.

FIG. 5 and FIG. 6 depict a position reference 100 and a position reference 102 respectively. Position reference 100 is received by central location 48 subsequent to transmission by portable monitoring device 20, more fully described elsewhere herein. (Position reference 100, a numeric value defines a location reference 104 is substantially identical to placement of portable monitoring device 20.) An excluded site 106 is defined by four (4) references 108, 110, 112 and 114 which are positioned at each corner thereof. A computer program, using methods conventionally known in the art, may be created which is capable of defining a boundary 116 based on references 108, 110, 112 and 114. Similarly, such a program could define any conceivable outline of a specific boundary. Boundary 116 extends around excluded site 106. The program could also be programed to determine if any specific position reference is inside of boundary 116. FIG. 5 depicts position reference 100 outside of excluded site 106. In this instance the program would not indicate, or otherwise report, a violation of excluded site 106. FIG. 6 depicts position reference 102 positioned within excluded site 106. In this instance the program would indicate, and report, a violation of excluded site 106 by portable monitoring device 20.

b. Historic Comparison

When a locational tracking database is created it may be utilized to determine if any of the monitored persons were within a defined area, as exampled by within the boundaries of a crime scene, during a defined period of time, as example by a window of opportunity in which time span the crime could have been committed.

Figure 7:
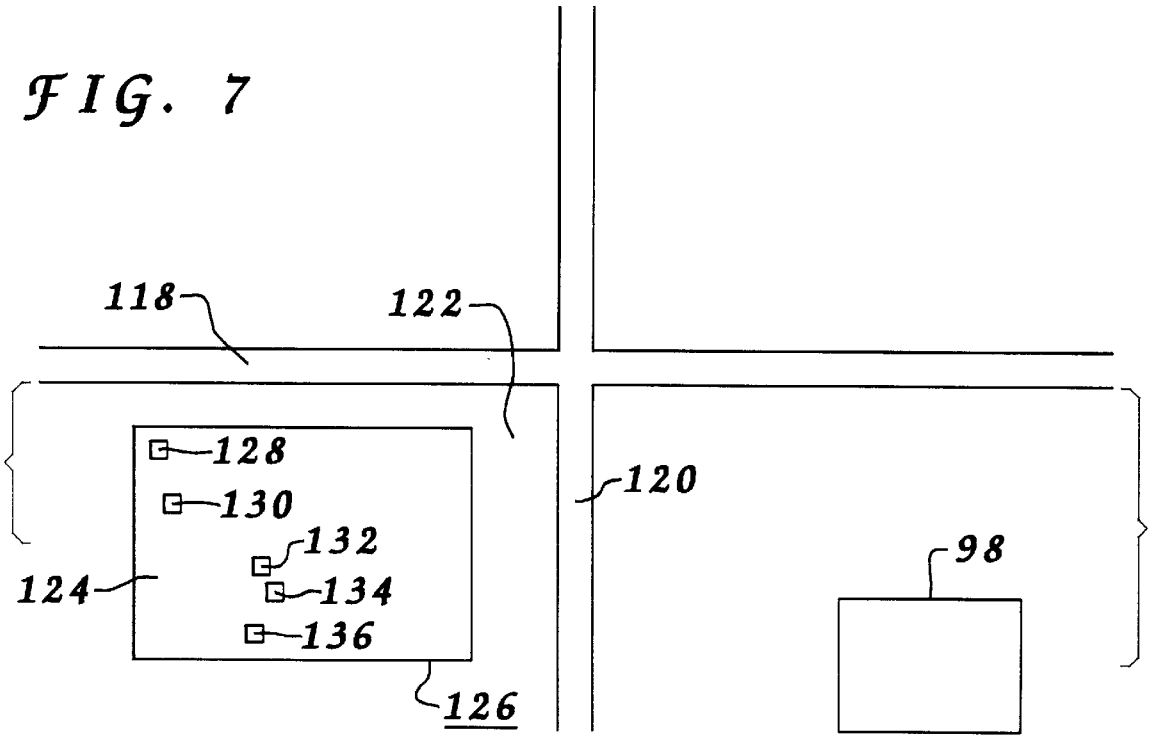
FIG. 7 is a plan view of an intersection of two streets and a comparative location reference.

FIG. 7 depicts a street 118 and a street 120 intersecting one another. A vacant lot 122 is situated on one corner of street 118 and street 120. A comparative location reference 124 has been identified and is surrounded by a boundary 126. A comparative temporal reference, not shown, which has a range of temporal references, has been entered. In this example boundary 126 falls completely within vacant lot 122.

A computer program, not shown, has examined all records within locational tracking database 98 and has identified a first position reference 128, a second position reference 130, a third position reference 132, a fourth position reference 134 and a fifth position reference 136 which have associated occurrence references, not shown, which fall within the comparative temporal reference. Each position reference 128,130,132,134 and 136 was created as a result of a single portable monitoring device, not shown. Therefore, it is possible to determine which monitored person, if any, was within the later-created comparative location reference 124 during a period of time represented by the comparative temporal reference.

Dual Tracking System

It is possible to provide for monitoring of a pair of persons to monitor the behavior of a first person, a restrictee person, relative to a second person, a restrictor person. There exist several possible combinations within the general concept of dual tracking. It is possible to have a clear pairing where there exists one restrictee person and one restrictor person. It is possible to have a single restrictee person monitored relative to a plurality of restrictor persons. It is possible to have multiple restrictee persons monitored relative to a single restrictor person.

The dual tracking system is applicable to several situations, but is particularly expedient in the enforcement of court issued restraining orders. The immediate comparison, the historic comparison or a combination of both types of comparison may be used. The historic comparison may be employed as evidence during a subsequent legal proceeding, as example as proof of violation of the court issued restraining order.

A computer program may be designed which defines a perimeter around the restrictor person of the pair of monitored persons which is updated depending upon the movement of the restrictor person. When the restrictee person enters within the perimeter a notification is given of such violation. This notification can be to an oversight authority, to the applicable restrictor person, or to both. When notification is given to the restrictor person communication therewith may be by any of the methods conventionally known in the art. Preferably, such notification would be received by the restrictor portable monitoring device which would then inform the restrictor person. It is also possible that human personnel at the central location would establish cellular communication with the restrictor person and advise the restrictor person of the position of the restrictee person relative to the restrictor person.

It is possible to provide for several unique perimeters around the restrictor person. Each unique perimeter would have a predefined distance measurement from the restrictor person. It is also possible to define various distinct notifications of violation of the different unique perimeters.

The computer program could be designed such that the position references of the restrictor person are not stored. This protects the privacy of the restrictor person which has not surrendered any of their rights. Alternatively, it is possible to store the applicable position references of the restrictor person only when the restrictee person is with a predetermined distance measurement of the restrictee person, as exampled by the perimeter previously described. This allows for the retention of such records for use during a subsequent legal proceeding. Such a program could be designed which retains the position references for a specific period of time, adding new position references and purging the oldest position references. Then, when a violation occurs all existing location references within the system could be stored. Storage would continue until a predetermined time following cessation of the violation. This arrangement allows for the preservation of the restrictor person's position references for a predetermined period of time prior to the violation, the entire period of time during the violation and for a predetermined period of time following the violation. The restrictee person's position references can similarly be stored, or all such data may be stored within the locational tracking database.

While applicable to several embodiments of the instant invention, an active intervention by a device located on the restrictee portable monitoring device is particularly applicable to the dual tracking system. When the restrictee person enters a predefined perimeter around the restrictor person, and when there is a prior conclusion reached by proper authorities that the restrictee person poses a physical threat to the restrictor person, the portable monitoring device may be activated to disable the restrictee person using any of the method conventionally known in the art. One example of a method of disabling the restrictee person would be through injection of a tranquilizer. Another example would be to stun the restrictee person with a high voltage charge.

Figure 8:
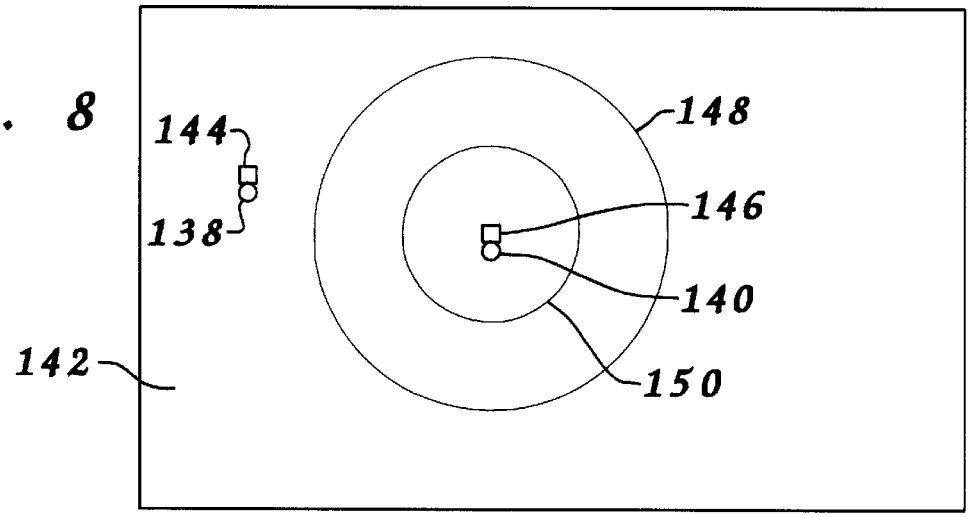
FIG. 8 through FIG. 10 are plan views of a block in various alternative orientations.
Figure 9:
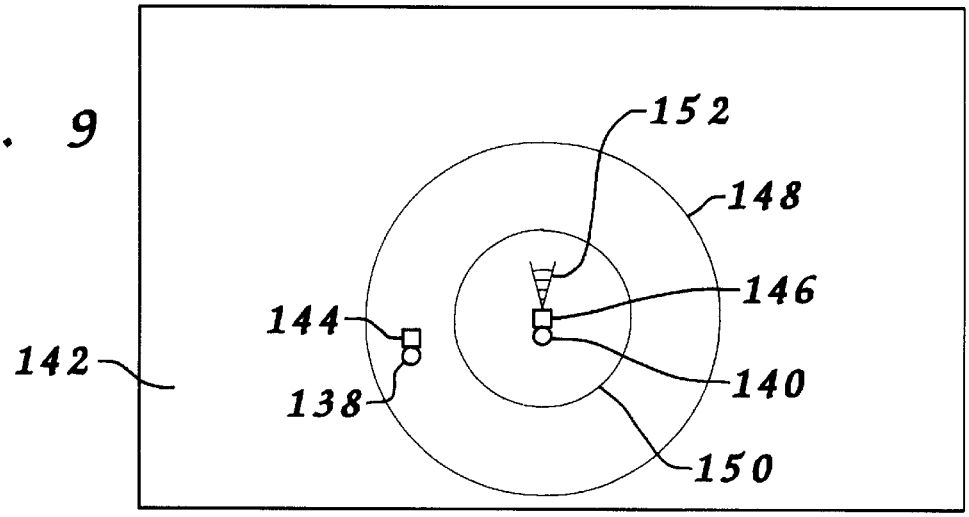
Figure 10:
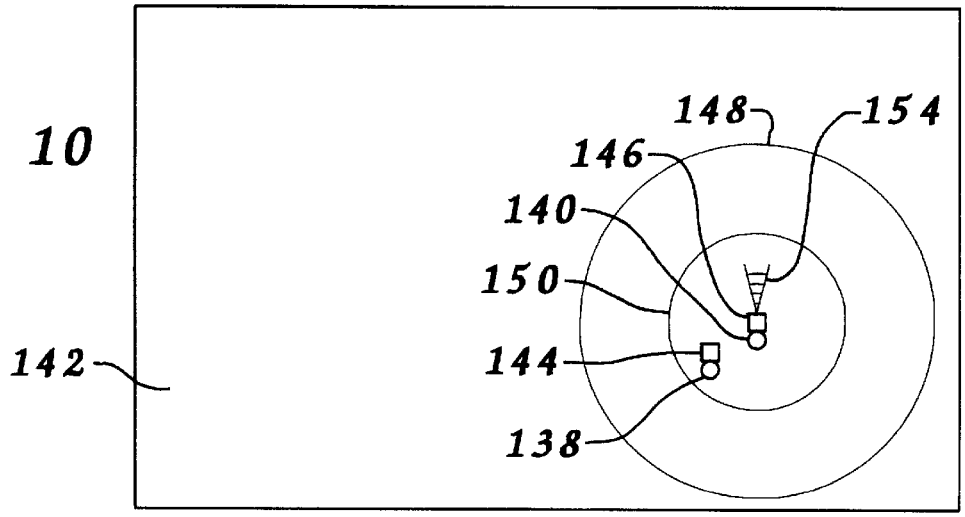

FIG. 8, FIG. 9 and FIG. 10 each depict a restrictee person 138 and a restrictor person 140 within a block 142. Restrictee person 138 has attached thereon a restrictee portable monitoring device 144. Restrictor person 140 carries with them a restrictor portable monitoring device 146. A first perimeter 148 radially surrounds restrictor portable monitoring device 146. A second perimeter 150, being smaller than first perimeter 148, radially surrounds restrictor portable monitoring device 146. Perimeters 148 and 150 are variable and move with restrictor portable monitoring device 146 as restrictor person 140 carries it about block 142. In FIG. 8 restrictee person 138 and restrictee portable monitoring device 144 are outside of both first perimeter 148 and second perimeter 150. In this instance no notification is given. In FIG. 9 restrictee person 138 and restrictee portable monitoring device 144 are inside of first perimeter 148, yet outside of second perimeter 150, and a first notification 152 is given. First notification 152 is exampled by a first beeping sound coming from restrictor portable monitoring device 146. In FIG. 10 restrictee person 138 and restrictee portable monitoring device 144 are inside of both first perimeter 148 and second perimeter 150 and a second notification 154 is given. Second notification 154 is exampled by a second beeping sound coming from restrictor portable monitoring device 146. The second beeping sound would be distinct from the first beeping sound.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tracking system to provide for locational tracking of a plurality of monitored persons, the tracking system comprising:

a) a portable monitoring device for each of the monitored persons, each portable monitoring device comprising:

1) securing means to provide for secure attachment of the portable monitoring device to a respective monitored person;

2) tamper detection means to provide for detecting tampering with the portable monitoring device attached to the respective monitored person;

3) receiving means to provide for receiving a distinct signal generated by a detached sending unit;

4) transmitting means to provide for transmission of a signal;

b) transmission acquisition means to provide for receiving the signals sent out by each of the portable monitoring devices;

c) positional determining means to provide for generating a position reference indicative of the positional location of each of the portable monitoring devices based upon the distinct signal received by the respective receiving means;

d) temporal marking means to provide for indicating, within at least a range of temporal references, an associated occurrence reference indicative of when the position reference to the positional location of each of the portable monitoring device occurred; and e) storage means to provide for an archival retention within a locational tracking database of at least a series of the position references and associated occurrence references of each of the portable monitoring devices of the tracking system, whereby the tracking system locationally tracks each of the portable monitoring devices and stores within the locational tracking database each of the position references containing information regarding the location of the monitored person and each of the associated occurrence references containing information regarding within at least the range of temporal references when the position reference to the positional location occurred.

2. The tracking system defined in claim 1 wherein the receiving means of the portable monitoring device receives at least one additional distinct signal generated by at least one additional detached sending unit.

3. The tracking system defined in claim 1 wherein the occurrence reference of the temporal marking means is produced by the portable monitoring device and wherein the occurrence reference is transmitted with the signal of the transmitting means of the portable monitoring device.

4. The tracking system defined in claim 1 wherein the position reference of the positional determining means is produced by each respective portable monitoring device and transmitted with the signal of transmitting means of the respective portable monitoring device.

5. A tracking reference system to provide for a historic reference to a locational tracking of a plurality of monitored persons, the tracking reference system comprising:

a) a portable monitoring device for each of the monitored persons, each portable monitoring device comprising:

1) securing means to provide for secure attachment of the portable monitoring device to a respective monitored person;

2) tamper detection means to provide for detecting tampering with the portable monitoring device attached to the respective monitored person;

3) receiving means to provide for receiving a distinct signal generated by a detached sending unit;

4) transmitting means to provide for transmission of a signal containing at least a position reference;

b) transmission acquisition means to provide for receiving the signals sent out by each of the portable monitoring devices;

c) positional determining means to provide for generating the position reference indicative of a positional location of each of the portable monitoring devices based upon the distinct signal received by the receiving means;

d) temporal marking means to provide for indicating, within at least a range of temporal references, an associated occurrence reference indicative of when the position reference to the positional location of the portable monitoring device occurred;

e) storage means to provide for an archival retention within a locational tracking database of at least a series of the position references and associated occurrence references of each of the portable monitoring devices of the tracking system;

f) comparative reference entry means to provide for entering a comparative location reference and a comparative temporal reference, the comparative location reference having a boundary comprising at least one location reference, the comparative temporal reference having at least a specific temporal reference; and g) comparison means to provide for comparing the comparative location reference and the comparative temporal reference with the position references and the associated occurrence references of the locational tracking database to determine if any of the monitored persons were within the boundary of the comparative location reference during the comparative temporal reference, whereby the tracking system locationally tracks each of the portable monitoring devices and stores within the locational tracking database at least the series of the position references containing information regarding the location of the monitored person and the associated occurrence references containing information regarding, within at least the range of temporal references, when the position reference to the positional location occurred and the comparative location reference and the comparative temporal reference may be entered for comparison with the position references and the associated occurrence references stored in the locational tracking database to determine if any of the monitored persons were within the boundary of the comparative location reference during the comparative temporal reference.

6. The tracking reference system defined in claim 5 wherein the receiving means of the portable monitoring device receives at least one additional distinct signal generated by at least one additional detached sending unit.

7. The tracking reference system defined in claim 5 wherein the occurrence reference of the temporal marking means is produced by the portable monitoring device and wherein the occurrence reference is transmitted with the signal of the transmitting means of the portable monitoring device.

8. The tracking reference system defined in claim 5 wherein the position reference of the positional determining means is produced by each respective portable monitoring device and transmitted with the signal of transmitting means of the respective portable monitoring device.

9. A dual tracking monitoring system to provide for locational monitor tracking of at least one pair of monitored persons, the pair of monitored persons having a restrictee person and a restrictor person, the dual tracking monitoring system comprising:

a) a restrictee portable monitoring device for the restrictee person of the pair of monitored persons, the restrictee portable monitoring device comprising:

1) securing means to provide for secure attachment of the restrictee portable monitoring device to the restrictee person;

2) tamper detection means to provide for detection of tampering with the restrictee portable monitoring device attached to the restrictee person;

3) restrictee receiving means to provide for receiving a distinct signal generated by a detached sending unit;

4) restrictee transmitting means to provide for restrictee transmission of a restrictee signal;

b) a restrictor portable monitoring device for the restrictor person of the pair of monitored persons, the restrictor portable monitoring device comprising:

1) transport means to provide for the restrictor person to transport the restrictor portable monitoring device therewith;

2) restrictor receiving means to provide for receiving a distinct signal generated by the detached sending unit;

3) restrictor transmitting means to provide for restrictor transmission of a restrictor signal containing at least a restrictor position reference;

c) transmission acquisition means to provide for receiving the restrictee signal and the restrictor signal;

d) restrictee positional determining means to provide for generating a restrictee position reference indicative of the restrictee positional location of the restrictee portable monitoring device;

e) restrictor positional determining means to provide for generating a restrictor position reference indicative of the restrictor positional location of the restrictor portable monitoring device;

f) comparison means to provide for comparing the restrictee position reference and the restrictor position reference subsequent to the transmission acquisition means receiving the restrictee signal and the restrictor signal; and g) notification means to provide for generating a notification in the event that the restrictee position reference and the restrictor position reference are within a predetermined distance measurement range;

h) temporal marking means to provide for indicating within at least a range of temporal references an associative restrictee occurrence reference indicative of when the restrictee receiving means received the distinct signal; and i) storage means to provide for an archival retention within a locational tracking database of at least a series of the restrictee position references and associative restrictee occurrence references, whereby the dual tracking monitoring system locationally monitors the restrictee person and the restrictor person and generates the notification in the event that the restrictee person and the restrictor person are within the predetermined distance measurement range.

10. A dual tracking monitoring system to provide for locational monitor tracking of at least one pair of monitored persons, the pair of monitored persons having a restrictee person and a restrictor person, the dual tracking monitoring system comprising:

a) a restrictee portable monitoring device for the restrictee person of the pair of monitored persons, the restrictee portable monitoring device comprising:

1) securing means to provide for secure attachment of the restrictee portable monitoring device to the restrictee person;

2) tamper detection means to provide for detection of tampering with the restrictee portable monitoring device attached to the restrictee person;

3) restrictee receiving means to provide for receiving a distinct signal generated by a detached sending unit;

4) restrictee transmitting means to provide for restrictee transmission of a restrictee signal;

b) a restrictor portable monitoring device for the restrictor person of the pair of monitored persons, the restrictor portable monitoring device comprising:

1) transport means to provide for the restrictor person to transport the restrictor portable monitoring device therewith;

2) restrictor receiving means to provide for receiving a distinct signal generated by the detached sending unit;

3) restrictor transmitting means to provide for restrictor transmission of a restrictor signal containing at least a restrictor position reference;

c) transmission acquisition means to provide for receiving the restrictee signal and the restrictor signal;

d) restrictee positional determining means to provide for generating a restrictee position reference indicative of the restrictee positional location of the restrictee portable monitoring device;

e) restrictor positional determining means to provide for generating a restrictor position reference indicative of the restrictor positional location of the restrictor portable monitoring device;

f) comparison means to provide for comparing the restrictee position reference and the restrictor position reference subsequent to the transmission acquisition means receiving the restrictee signal and the restrictor signal; and g) notification means to provide for generating a notification in the event that the restrictee position reference and the restrictor position reference are within a predetermined distance measurement range;

h) restrictee temporal marking means to provide for indicating within at least a range of restrictee temporal references an associative restrictee occurrence reference indicative of when the restrictee receiving means received the distinct signal;

i) restrictor temporal marking means to provide for indicating within at least a range of restrictor temporal references an associative restrictor occurrence reference indicative of when the restrictor receiving means received the distinct signal; and j) storage means to provide for an archival retention of data within a locational tracking database, the archival retention occurring at least during those time periods when the restrictee position reference and the restrictor position reference are within the predetermined distance measurement range, the data comprising:

1) the restrictee position references;

2) the associative restrictee occurrence references;

3) the restrictor position references;

4) the associative restrictor occurrence references, whereby the dual tracking monitoring system locationally monitors the restrictee person and the restrictor person and generates the notification in the event that the restrictee person and the restrictor person are within the predetermined distance measurement range.

* * * * *